US005111647A

United States Patent [19]

Gabalda

[11] Patent Number: 5,111,647

[45] Date of Patent: May 12, 1992

[54] TWISTING SPINDLE DRIVEN BY AN INDIVIDUAL ELECTRIC MOTOR

[75] Inventor: Carlos M. Gabalda, Granges Les Valence, France

[73] Assignee: ICBT Lyon, Caluire, France

[21] Appl. No.: 509,778

[22] Filed: Apr. 17, 1990

[30] Foreign Application Priority Data

Apr. 25, 1989 [FR] France ..... 89 05768

[51] Int. Cl.[5] ..... D01H 13/00; D01H 7/86; H02K 5/00

[52] U.S. Cl. ..... 57/100; 57/58; 57/49; 57/58.86; 310/89

[58] Field of Search ..... 310/90, 89, 91, 42; 384/603, 541; 57/58.49, 81, 100, 58.86

[56] References Cited

U.S. PATENT DOCUMENTS

| | | | |
|---|---|---|---|
| 1,363,087 | 12/1920 | Clayton | 57/100 |
| 1,813,611 | 7/1931 | Dickie et al. | 57/100 |
| 4,420,926 | 12/1983 | Remontet | 57/100 |
| 4,633,664 | 1/1987 | Mueller-Storz et al. | 57/100 X |
| 4,642,980 | 2/1987 | Fukunaga et al. | 57/58.86 |
| 4,728,838 | 3/1988 | Mandel et al. | 310/90 X |
| 4,875,334 | 10/1989 | Rajsigl et al. | 57/100 X |
| 4,908,534 | 3/1990 | Gubler et al. | 57/100 X |
| 4,955,128 | 8/1990 | Sogabe et al. | 310/89 X |

FOREIGN PATENT DOCUMENTS

| | | | |
|---|---|---|---|
| 2508499 | 12/1982 | European Pat. Off. . | |
| 0344474 | 12/1989 | European Pat. Off. | 57/100 |
| 408576 | 1/1925 | Fed. Rep. of Germany . | |
| 650239 | 1/1929 | France . | |

*Primary Examiner*—Daniel P. Stodola
*Assistant Examiner*—William Stryjewski
*Attorney, Agent, or Firm*—Parkhurst, Wendel & Rossi

[57] ABSTRACT

A double-twist twisting spindle (2) driven by an individual electric motor (9), the stator (10) of which is fastened to the supporting stand (1) of the machine and the rotor (11) of which is fixed to the shank (2) of the spindle, a stationary package holder (3) being arranged in the extension of the spindle. The mounting of the stationary members on the machine stand (1) is carried out by a sleeve (12) mounted elastically on the stand (1) and fixed to the housing of the motor, the bearings (14, 15) which guide and support the spindle being mounted on the inside of an intermediate bush (16) mounted removably on the inside of the supporting sleeve (12).

6 Claims, 3 Drawing Sheets

TWISTING SPINDLE DRIVEN BY AN INDIVIDUAL ELECTRIC MOTOR

BACKGROUND OF THE INVENTION

The present invention relates to an improvement made to the spindles used in the textile industry, especially for the twisting of yarns.

Twisting spindles are devices which have been known for a very long time and consist essentially of a shaft (or spindle shank) mounted freely rotatably on the stand of the machine by means of a suitable bearing.

In addition to so-called "single-twist" spindles, in which the tube around which the yarn is wound is fitted directly onto the spindle shank and which therefore make it possible to obtain one twisting turn on the yarn for one rotation of the spindle, it has been proposed for a very long time to provide so-called "double-twist" spindles which, like the preceding spindles, comprise a vertical shank driven in rotation. In both cases, the most widespread system involves the use, as means for driving in rotation, of an endless belt which drives all spindles of the machine simultaneously and which is in tangential contact with the base of the shank of the spindle.

Where single-twist twisting spindles are concerned, it has been proposed for a very long time, as disclosed particularly in French Patent 650,239 and in U.S. Pat. No. 2,274,147, to drive the spindles individually by means of an electric motor. Many improvements to such a system for driving by individual motor have been proposed. Of the recent solutions, mention may be made of that which is the subject of French Patent 81/12,918 (Publication 2,508,499), corresponding to U.S. Pat. No. 4,420,926, which has the advantage over the prior solutions of allowing a highly effective damping of the vibrations, of lowering the center of gravity of the assembly as a whole in relation to the supporting stand, of being silent, and of being easily dismountable, especially during a maintenance operation.

However, as regards double-twist spindles which are of a much more complex design in comparison with single-twist spindles, the drive by means of an individual motor still presents some problems, especially with regard to the ease with which the elements forming the "textile part" of such assemblies are dismounted, these elements consisting essentially of a package holder concentric relative to the axis of the spindle intended for receiving the yarn reel to be twisted, this package being composed essentially of a stationary axis arranged in the movable axis, of a base, of a protective can fitted onto the base, of a rotary guide plate fixed to the actual spindle and located in a horizontal plane under the package holder, and means for immobilizing said package holder.

SUMMARY OF THE INVENTION

Now we have found, as is the subject of the present invention, an improvement made to double-twist spindles, which not only allows the spindles to be driven by means of an individual control motor, but also leads to the production of a completely dismountable assembly, the textile part being separable very easily from the stator part of the motor fastened to the machine stand.

In general terms, the invention therefore relates to a double-twist twisting spindle driven by an individual electric motor, the stator of which is fastened to the supporting stand of the machine and the rotor of which is fixed to the spindle shank, a stationary package holder being arranged in the extension of the spindle. The spindle according to the invention is defined in that the mounting of the stationary members on the machine stand is carried out by means of a sleeve mounted elastically on the stand and fixed to the housing of the motor, the bearings which guide and support the movable members of the spindle being mounted on the inside of an intermediate bush fastened removably on the inside of the supporting sleeve.

However, the invention and the advantages which it affords will be better understood from the exemplary embodiment which is given below as a non-limiting indication and which is illustrated by the accompanying diagrams in which:

BRIEF DESCRIPTION OF THE DRAWINGS

FIG. 3 shows all the members forming the textile part of the spindle.

DESCRIPTION OF THE PREFERRED EMBODIMENT

It goes without saying that this exemplary embodiment is non-limiting, and that the same type of spindle could be used to impart a twist to a single yarn.

Figure 1:
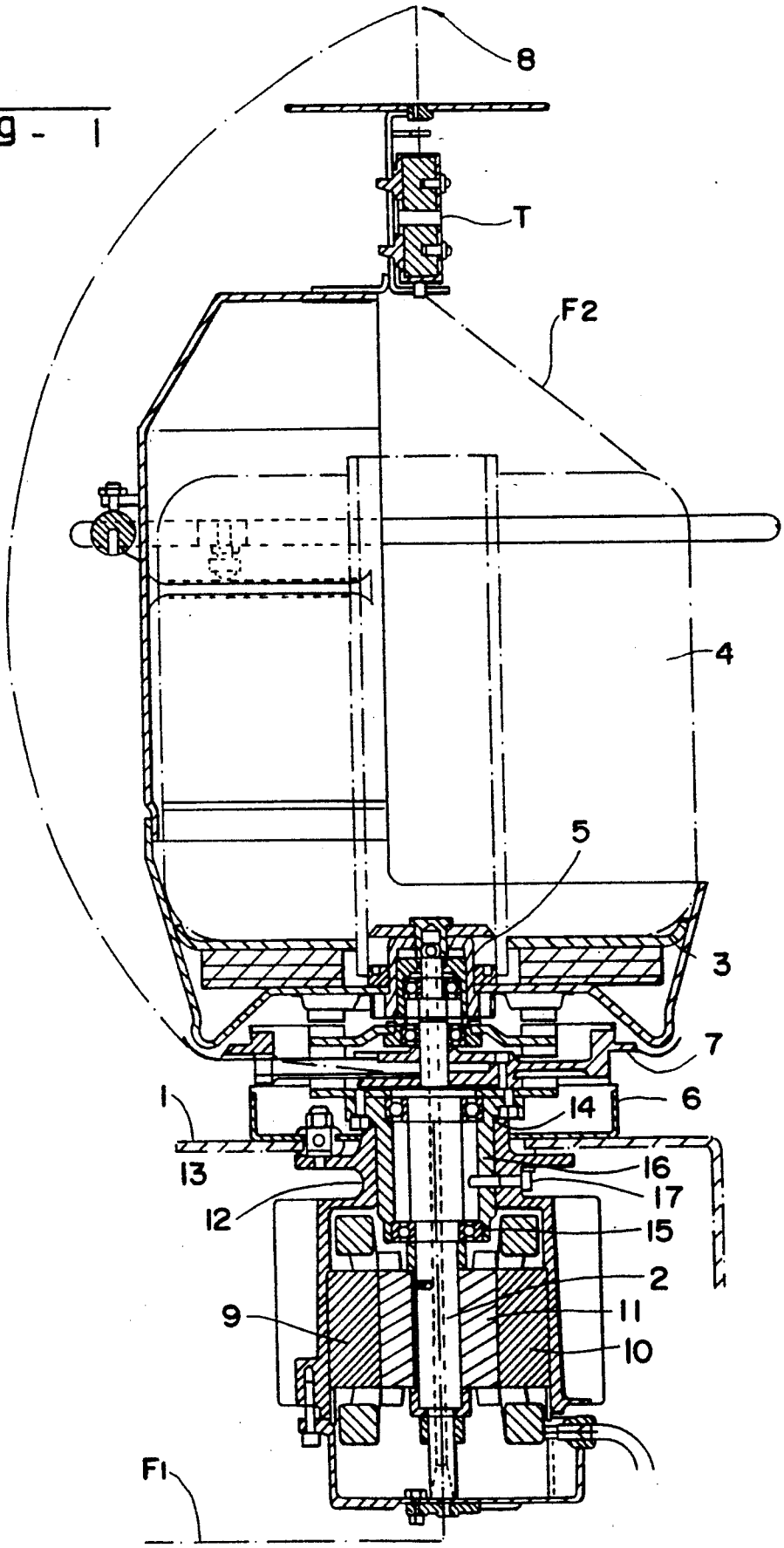
FIG. 1 is a sectional view of an entire double-twist spindle according to the invention used during a direct stranding operation, that is to say for twisting two elementary yarns together.

As can be seen in the accompanying figures, the double-twist spindle produced according to the invention consists essentially of an assembly mounted on the stand (1) of the machine and composed essentially of a shank (2) which is intended to be driven in rotation and above which are mounted the main members forming the textile part of the spindle. These members consist essentially of a stationary package holder (3) which is intended for a yarn reel (4) mounted on a stationary base (5) and around which a deflector (6) is mounted. A rotary guide plate (7) fixed to the shank (2) of the vertical spindle is arranged underneath the package holder (3). In the embodiment illustrated in FIG. 1, where the double-twist spindle according to the invention is used for carrying out a direct stranding operation, a yarn (F1) passes through the shank (2) of the spindle and forms a balloon around the above-described assembly. The second yarn (F2) which comes from the reel (4) passes through a tension device (T). The two yarns are combined at (8).

Figure 3:
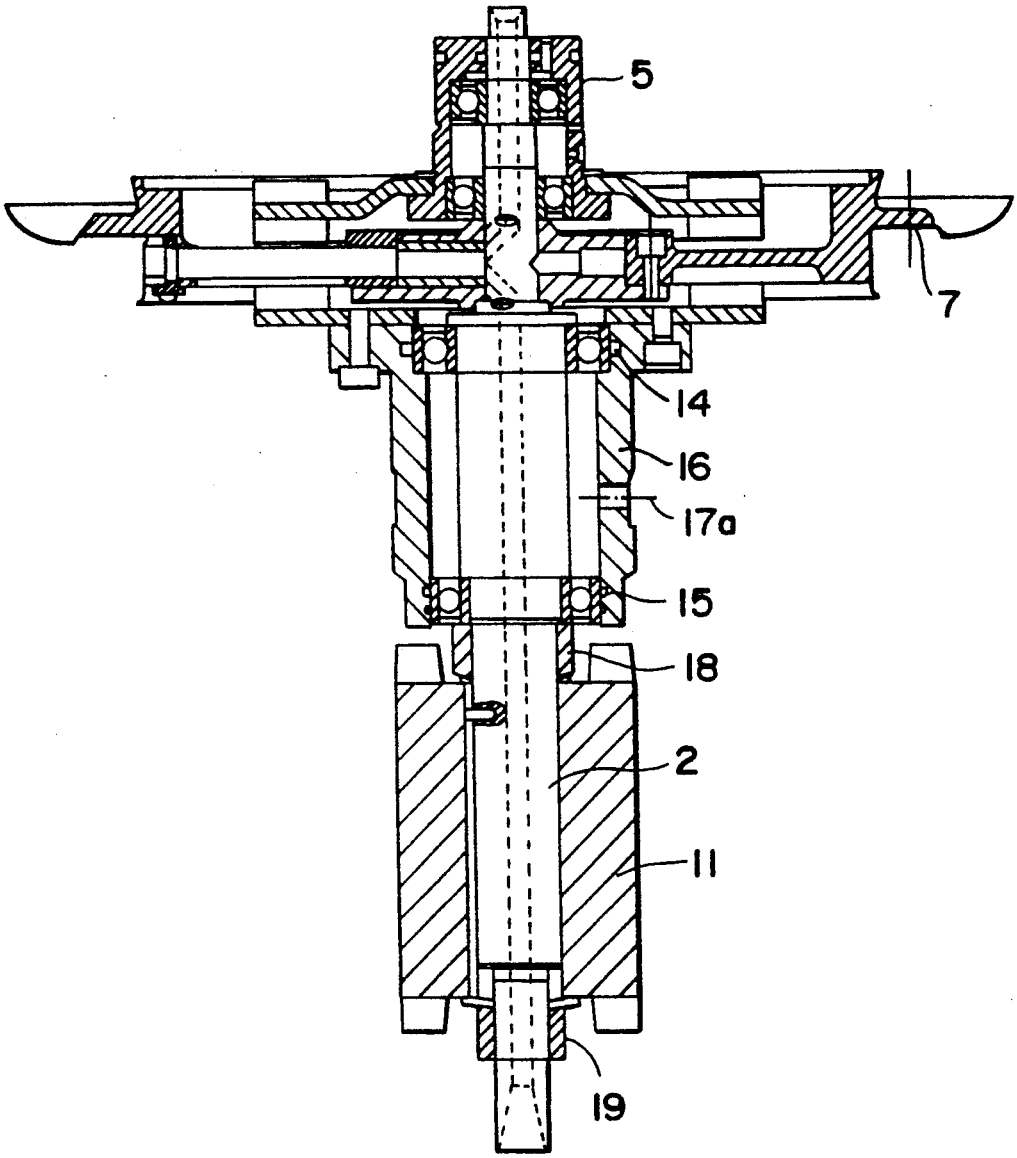

The rotational drive of the movable members of the spindle (which are shown in FIG. 3) and more particularly of the shank (2) is obtained by means of an individual motor designated by the general reference (9). This individual motor consists essentially of a stator (10) and of a rotor (11). The stator (10) is mounted on the machine stand (1) by means of a sleeve (12) arranged on the inside of the body of the motor. This sleeve (12) is fastened to the stand (1) by means of elastic studs (13). The rotor (11) is itself mounted at the end of the spindle shank (2) (see FIG. 3).

Figure 2:
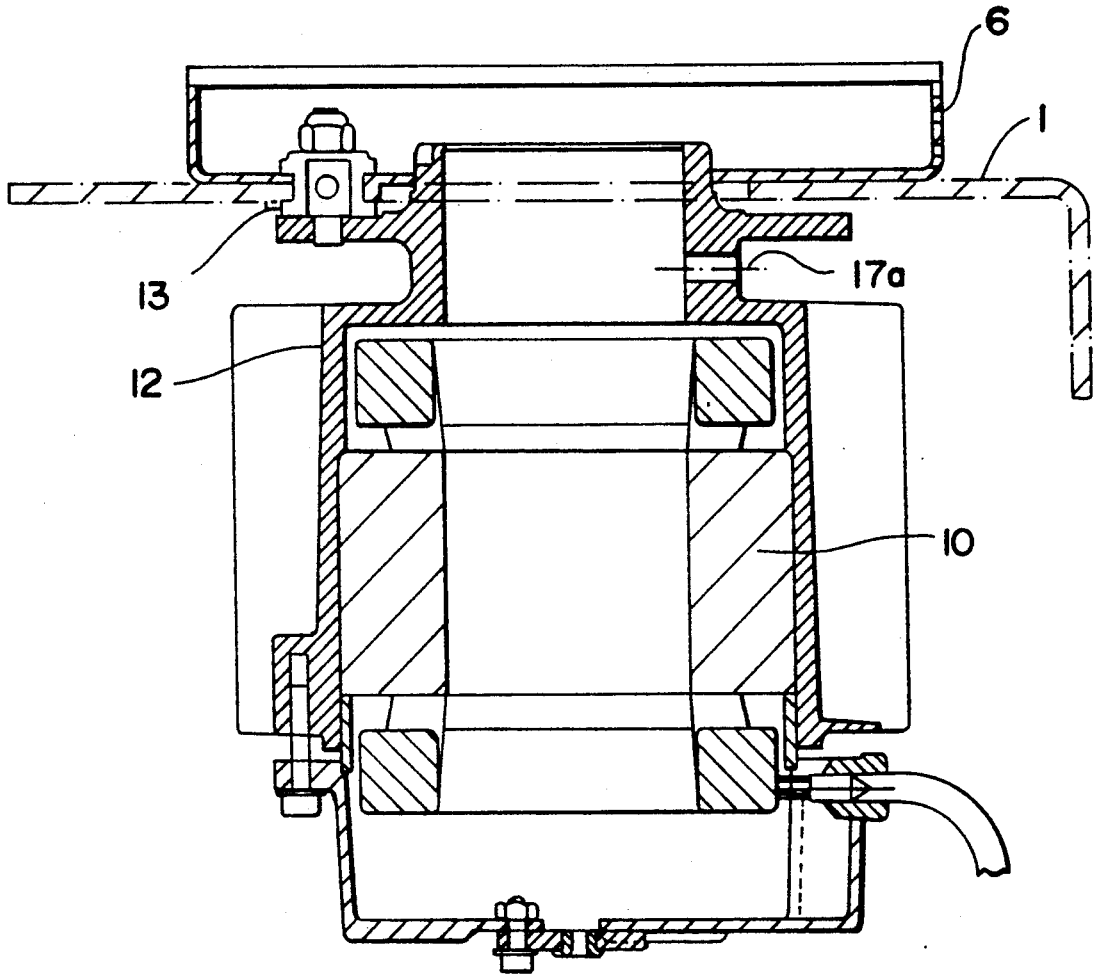
FIGS. 2 and 3 are partial views, enlarged in relation to FIG. 1, showing in more detail the structure of the spindle according to the invention when it is dismounted, FIG. 2 corresponding to the elements of the spindle which remain fixed to the machine stand, whilst

According to the invention, the spindle shank (2) is mounted on the inside of the stationary sleeve (12) by means of bearings (14, 15) which are mounted on the inside of an intermediate bushing (16) immobilized inside the sleeve (12) by means of a locking screw (17). FIGS. 2 and 3, where the spindle according to the invention is shown dismounted, do not illustrate the locking screw (17), only the axis (17*a*) in which the junction between the elements is made being indicated. A spacer (18) and a nut (19) arranged around the shank (2) make it possible to ensure that the rotor (11) is immobilized around the shank.

The advantage of such an assembly of especially simple design is that it can be dismounted very easily, since it is sufficient to unscrew the locking screw (17) in order to remove all the elements forming the textile part of the spindle (which are shown in FIG. 3).

Of course, the invention is not limited to the exemplary embodiment described above, but embraces all its alternative versions produced in the same spirit.

I claim:

1. A double-twist twisting spindle for use in a textile apparatus comprising:

a spindle shank having first and second ends, and a central axis corresponding to the axial direction of said double-twist twisting spindle;

a rotor mounted to said first end of said shank;

a machine stand vertically supporting said shank and disposed between said first and said second end of said shank;

a motor housing arranged around said first end of said shank;

a supporting sleeve having first and second ends, said sleeve being fixed inside said motor housing at said first end thereof and being elastically mounted to said machine stand at said second end thereof;

a stator fixed to an interior of said first end of said sleeve within said motor housing, wherein said stator and said rotor comprise an electric motor within said motor housing and interact to rotatably drive said shank;

a bushing disposed at an interior of said second end of said sleeve;

bearings mounted to an interior of said bushing for securing said shank therein;

a rotary guide member mounted on said second end of said shank;

holding means adjacent to said rotary guide member for holding a reel of yarn such that the central axis of said reel of yarn extends in said axial direction;

a locking device for removably mounting said bushing to said sleeve, wherein said shank, said rotor, said bushing, said bearings, said rotary guide member and said holding means can simultaneously be freely removed from said sleeve in an axial direction of said shank upon unlocking said locking device.

2. The spindle of claim 1, wherein said locking device consists of a screw.

3. The spindle of claim 1, further comprising elastic studs for elastically mounting said sleeve to said machine stand.

4. A textile apparatus, comprising:

a double-twist twisting spindle comprising:

a) a spindle shank having first and second ends, said shank having a bore formed therein through which first yarn passes, said spindle shank having a central axis corresponding to the axial direction of said double-twist twisting spindle;

b) a rotor mounted to said first end of said shank;

c) a machine stand vertically supporting said shank and disposed between said first and said second end of said shank;

d) a motor housing arranged around said first end of said shank;

e) a supporting sleeve having first and second ends, said sleeve being fixed inside said motor housing at said first end thereof and being elastically mounted to said machine stand at said second end thereof;

f) a stator fixed to an interior of said first end of said sleeve within said motor housing, wherein said stator and said rotor comprise an electric motor within said motor housing and interact to rotatably drive said shank;

g) a bushing disposed at an interior of said second end of said sleeve;

h) bearings mounted to an interior of said bushing for securing said shank therein; and i) a rotary guide member mounted to said second end of said shank, said guide member guiding said first yarn from said bore in said shank around a second yarn which comes from a yarn reel;

j) holding means arranged adjacent said rotary guide member for holding a reel of second yarn such that the central axis of said reel extends in said axial direction;

k) a locking device for removably mounting said bushing to said sleeve, wherein said shank, said rotor, said bushing, said bearings, said rotary guide member and said holding means can simultaneously be freely removed from said sleeve in the axial direction of said shank upon unlocking said locking device; and l) means for applying tension to said second yarn leaving said reel, said first yarn and said second yarn being combined downstream of said tension means.

5. The apparatus of claim 4, wherein said locking device consists of a screw.

6. The apparatus of claim 4, further comprising elastic studs for elastically mounting said sleeve to said machine stand.

* * * * *